US008459821B1

(12) United States Patent
Fusilier

(10) Patent No.: US 8,459,821 B1
(45) Date of Patent: Jun. 11, 2013

(54) APPARATUS FOR SAFE CARRIAGE OF A DRINK VESSEL WITHIN A DARKENED AREA

(76) Inventor: Karen Fusilier, Wichita, KS (US)

( * ) Notice: Subject to any disclaimer, the term of this patent is extended or adjusted under 35 U.S.C. 154(b) by 270 days.

(21) Appl. No.: 12/902,294

(22) Filed: Oct. 12, 2010

Related U.S. Application Data

(60) Provisional application No. 61/288,896, filed on Dec. 22, 2009.

(51) Int. Cl.
*F21V 33/00* (2006.01)

(52) U.S. Cl.
USPC ..... 362/101; 362/109; 362/317

(58) Field of Classification Search
USPC ..... 362/101, 109, 205, 249.05, 311.02, 362/317
See application file for complete search history.

(56) References Cited

U.S. PATENT DOCUMENTS

| | | | | |
|---|---|---|---|---|
| 2,745,947 | A | 5/1956 | Sansous | |
| 4,656,566 | A | 4/1987 | Kelley | |
| 4,886,183 | A | 12/1989 | Fleming | |
| 5,119,279 | A | 6/1992 | Makowsky | |
| 6,092,905 | A | 7/2000 | Koehn | |
| 6,179,436 | B1 | 1/2001 | Gitkind | |
| 7,172,533 | B2 | 2/2007 | Hobbs | |
| 2005/0036301 | A1 * | 2/2005 | Haines | 362/101 |
| 2005/0063176 | A1 * | 3/2005 | Sutton | 362/101 |
| 2005/0195590 | A1 * | 9/2005 | Bigger | 362/109 |
| 2009/0080180 | A1 | 3/2009 | Bertken | |

* cited by examiner

*Primary Examiner* — David V Bruce
(74) *Attorney, Agent, or Firm* — Kenneth H. Jack; Davis & Jack, LLC

(57) ABSTRACT

An apparatus for safe carriage of a drink vessel within a darkened area, the apparatus including a receptacle having an upper opening, the receptacle's upper opening being fitted for nestingly receiving the drink vessel; the apparatus further including an attached and underlying illumination component case, the illumination component case housing light emitter, battery, electrical conductor and electrical switching elements.

4 Claims, 6 Drawing Sheets

APPARATUS FOR SAFE CARRIAGE OF A DRINK VESSEL WITHIN A DARKENED AREA

This regular patent application claims the benefit of the filing date of U.S. Provisional Patent Application No. 61/288,896 filed by Inventor/Applicant, Karen Fusilier, on Dec. 22, 2009, and entitled "Koozie Flashlight." The Karen Fusilier who is the Applicant herein is one and the same person as the Karen Fusilier who is the Applicant in said provisional application. The Specification and drawings of the instant application are substantially directed to the same structure and subject matter disclosed in said provisional application. The filing date of the instant application precedes the first anniversary of the filing date of said provisional application.

FIELD OF THE INVENTION

This invention relates to drink carrying receptacles and light emitting electric torches. More particularly, this invention relates to specialized modifications applicable to such receptacles and torches for safe usage within darkened areas.

BACKGROUND OF THE INVENTION

Parties and social gatherings are commonly held out of doors and during darkened evening hours. In many cases, grounds within which such parties are held are incompletely illuminated, creating areas of hazardous footing for party goers. Accordingly, it is often desirable for attendees at such parties to carry an electric torch or flashlight. Yet, in many circumstances, attendees at such parties wish to carry a drink in one hand and another object such as a plate of food in the other hand. Such common hand carrying of articles during parties often makes it difficult for such party attendees to further carry and utilize the needed electric torch.

The instant inventive apparatus for safe carriage of a drink vessel within a darkened area solves or ameliorates the problems discussed above by specially adapting a drink carrying receptacle for dually or additionally functioning as an electric torch.

BRIEF SUMMARY OF THE INVENTION

A first structural component of the instant apparatus for safe carriage of a drink vessel within a darkened area comprises a receptacle having an upper opening, and being fitted for receiving a drink vessel. Where the drink vessel comprises bottled or canned pop or beer, the receptacle's an upwardly opening space is preferably cylindrical and has a circular horizontal cross-sectional profile whose inside diameter is closely fitted for nesting receipt of such drink vessel. In a preferred embodiment, the receptacle is composed of a foam elastomer making the receptacle slightly stretchable for fitted receipt of drink vessels having various diameters, and allowing the receptacle to perform a thermal insulating function for keeping a received drink cool for an extended period of time.

A further structural component of the instant inventive apparatus comprises illuminating means which are preferably electrically actuated and powered. In a preferred embodiment, the illuminating means comprise a plurality of light emitting diodes. Suitably, the illuminating means may alternatively comprise an incandescent bulb or a florescent bulb. In the preferred embodiment, the illuminating means preferably further comprise at least a first electric storage battery, a network of electrical conductors including the battery and the light emitter within a circuit, and including on/off switching means which are connected operatively within such circuit.

A further structural component of the instant inventive apparatus comprises attaching means which are connected operatively to a lower end of the receptacle, the attaching means preferably housing, supporting, and downwardly directing the illuminating means. In a preferred embodiment, the attaching means comprise a circular cylindrical plastic case whose upper end is fitted for attachment to a lower end of the receptacle, and whose lower end is fitted and adapted for housing and supporting the electric powered light emitter. Preferably, the attaching means positions the light emitting components of the illuminating means for casting light downwardly from the lower end of the drink vessel receiving receptacle.

In use of the instant inventive apparatus for safe carriage of a drink vessel within a darkened area, a user may nestingly insert a drink vessel into the receptacle and may actuate the apparatus's illuminating means by manipulating a suitably provided single throw on/off switch or rotary switch mounted at a lower end of the apparatus. As a result of such illuminating actuation, the inventive apparatus advantageously casts light downwardly through darkened areas toward the ground, illuminating ground areas and illuminating potentially tripping obstacles at the user's feet.

During use of the instant inventive apparatus, the user may allow one of his or her hands to be occupied with carrying an object such as a food plate, while the other hand simultaneously carries a drink and directs light downwardly for obstacle detection and tripping prevention.

Accordingly, it is an object of the instant invention to provide an apparatus for safe carriage of a drink vessel within a darkened area which incorporate structures, as described above, and which arranges those structures in manners described above for the performance of beneficial functions, as described above.

Other and further objects, benefits, and advantages of the present invention will become known to those skilled in the art upon review of the Detailed Description which follows, and upon review of the appended drawings.

DETAILED DESCRIPTION OF PREFERRED EMBODIMENTS

Figure 1:
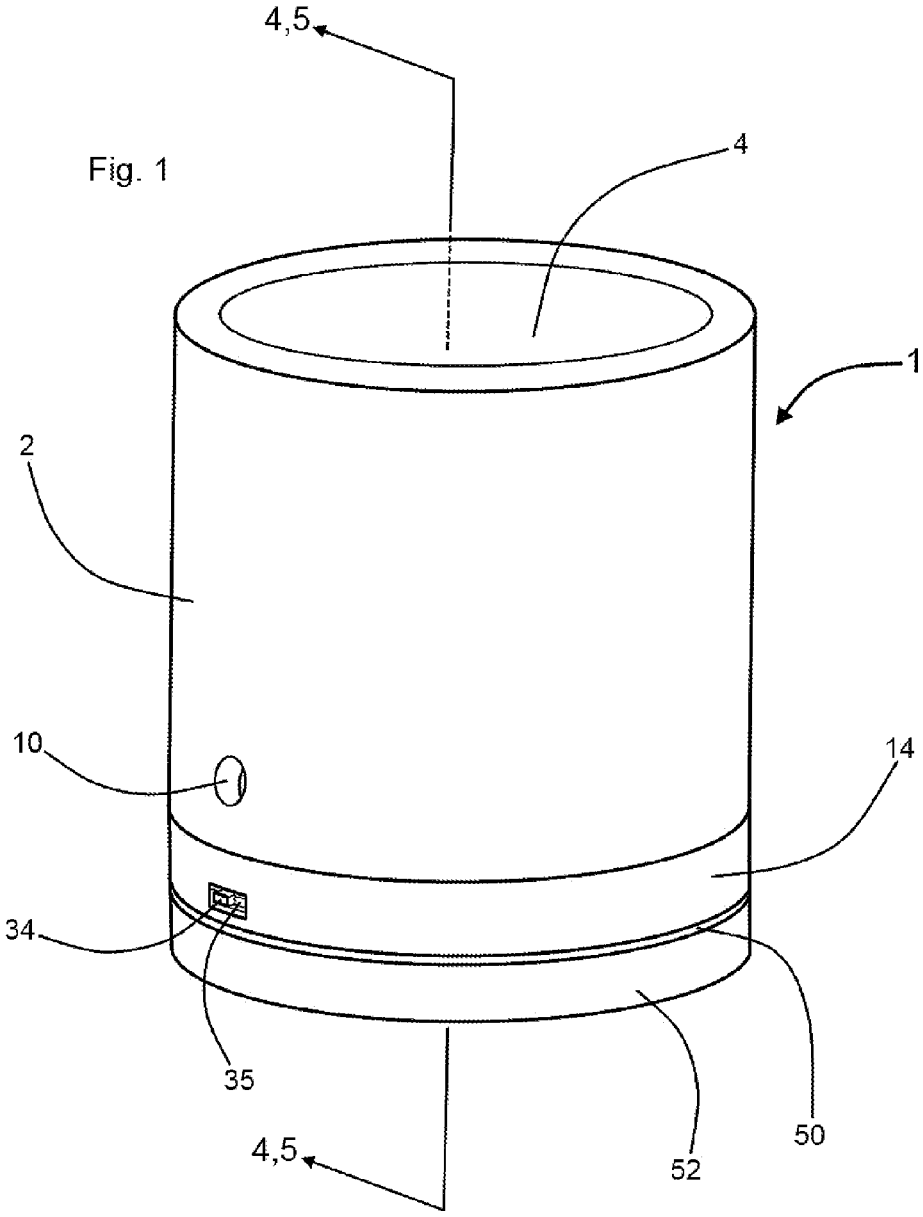
FIG. 1 is a perspective view of a preferred embodiment of the instant inventive apparatus for safe carriage of a drink vessel within a darkened area.
Figure 4:
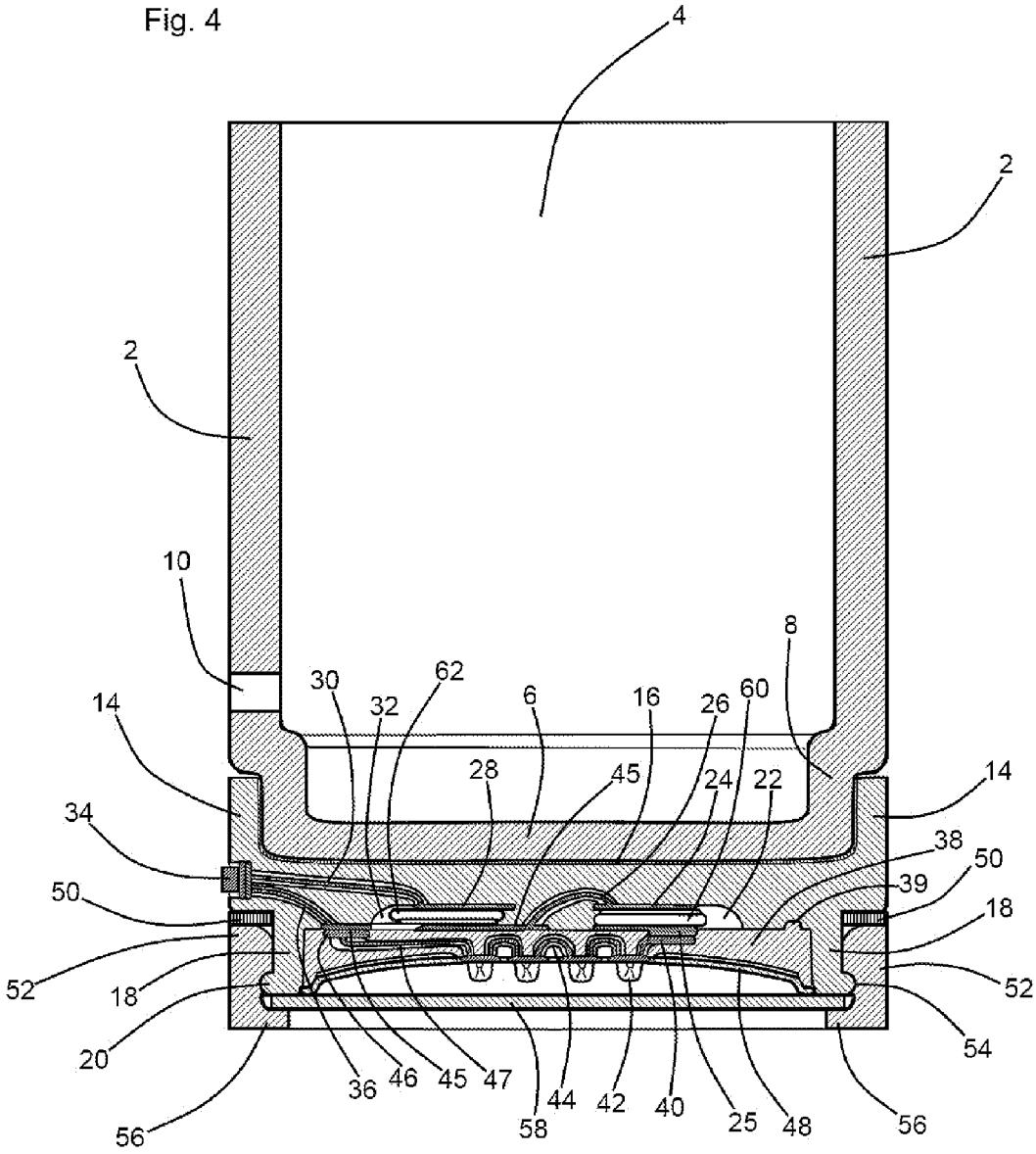
FIG. 4 is a sectional view as indicated in FIG. 1.

Referring now to the drawings, and in particular to FIG. 1, a preferred embodiment of the instant inventive apparatus for safe carriage of a drink vessel within a darkened area is referred to generally by Reference Arrow 1. The apparatus 1 comprises a receptacle 2 which forms and defines an upwardly opening hollow interior space 4. Referring further simultaneously to FIG. 4, the receptacle 2 has a lower and annular inset section 8 which facilitates fitted receipts of variously sized drink vessels, such as drink cans, bottles, and the like. An air passage port 10 through the wall of the receptacle 2 is preferably provided for air emission or aspiration, such port relieving any back or vacuum pressure which may undesirably resist insertions and extractions of drink vessels into and out of the receptacle 2. In a preferred embodiment, the receptacle 2 comprises a flexible and durable elastomer foam for enhanced ability to receive variously sized drink vessels, and for thermally insulating inserted drink vessels.

Figure 2:
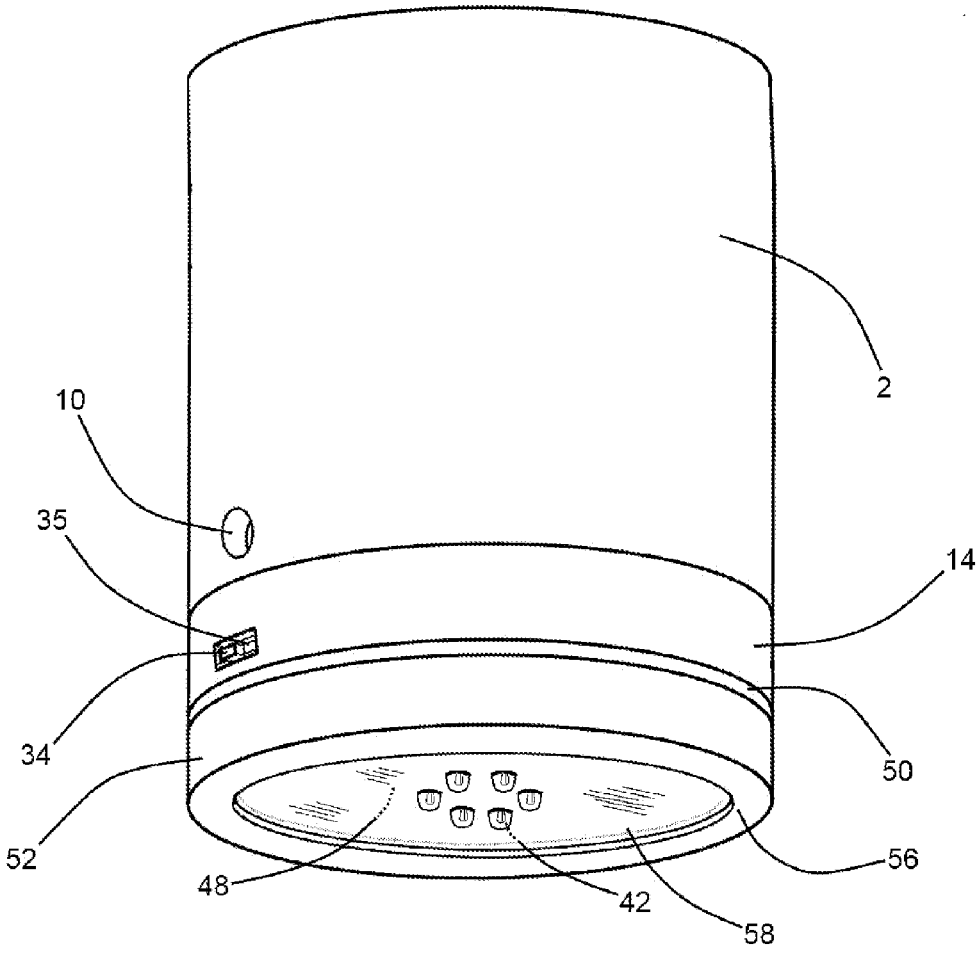
FIG. 2 redepicts the structure of FIG. 1, the view of FIG. 2 being from a view alternatively showing undersurface structures.

Referring simultaneously to FIGS. 1 and 2, the instant inventive apparatus 1 preferably further comprises illuminating means which preferably incorporate a plurality of light emitting diodes 42. The depicted light emitting diodes 42 are intended as being representative of other suitably used electrically powered light emitters such as incandescent bulbs and florescent bulbs.

Referring to FIG. 4, the illuminating means component of the instant apparatus preferably further comprise at least a first, and preferably first and second electric storage batteries 60 and 62. A network of electrical conductors 47, 46, 45, 36, 30, 28, 45, 26, 24, 25, 40, and 44, which incorporate and interconnect the light emitters 42 and the batteries 60 and 62 within an electrical circuit constitute preferred further components of the illuminating means. A single throw on/off switch 34 or alternatively, referring to FIGS. 5, 6, and 7, a rotary switch 89, 84, 90, 74, 66, is preferably provided as an additional illuminating means component.

Figure 5:
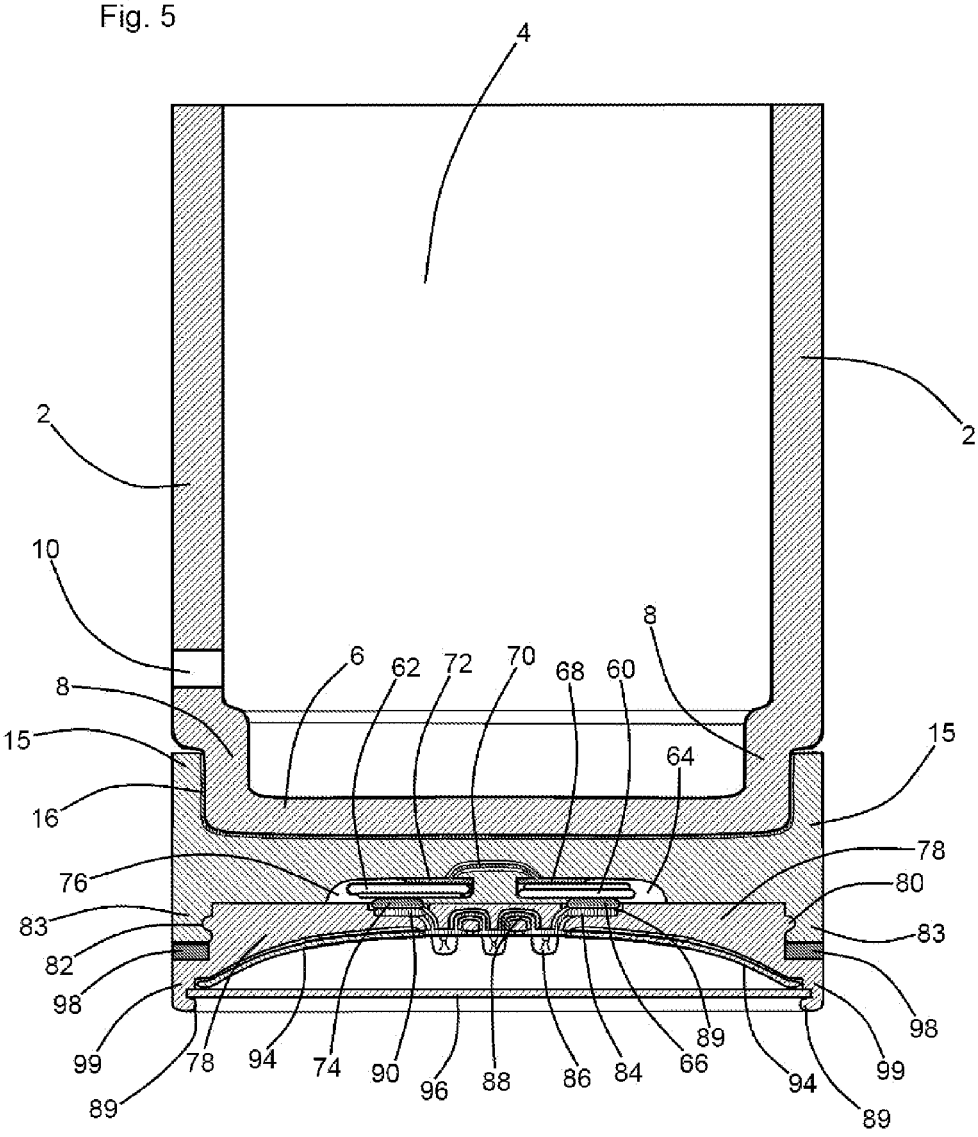
FIG. 5 presents a sectional view of an alternatively configured apparatus, the view being as indicated in FIG. 1.
Figure 6:
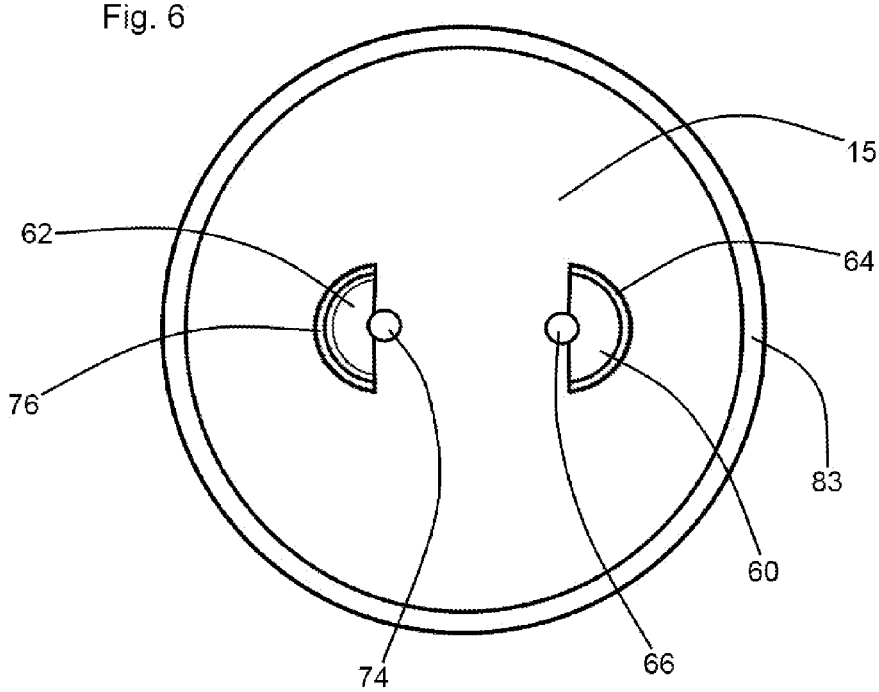
FIG. 6 is an under surface view of a first case component of the FIG. 5 structure.
Figure 7:
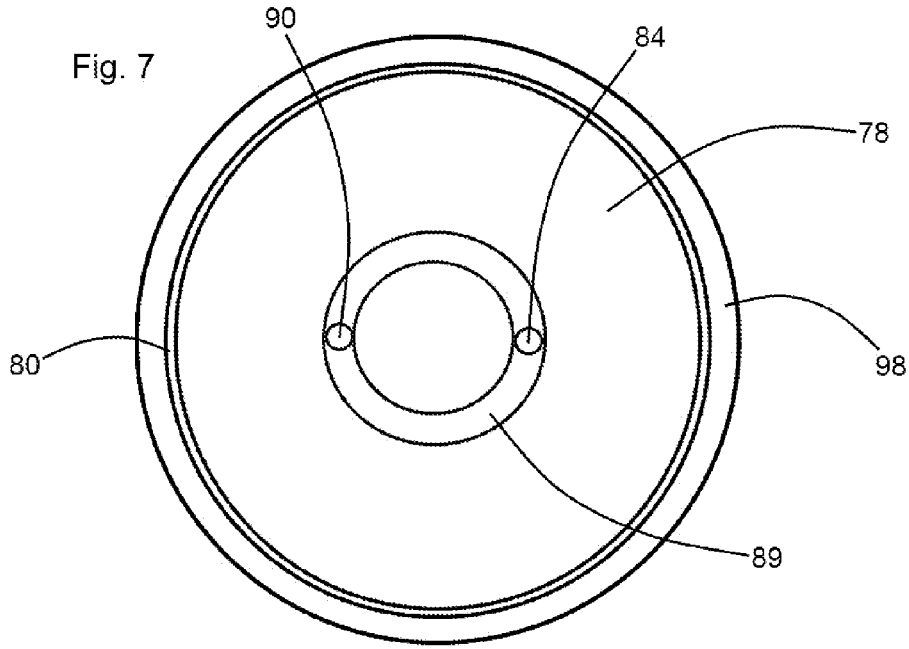
FIG. 7 is an upper surface view of a second case component of the FIG. 5 structure.

Referring further to FIG. 4, attaching means for suspending and positioning the illuminating means at the lower end or floor 6 of the receptacle 2 are preferably provided, such means suitably comprising a vertically sectioned or vertically partitioned cylindrical case 14, or with reference to the alternatively switched configuration of FIGS. 5-7, a cylindrical case 15. The upper end of the case, 14 or 15 as the case may be, preferably forms and upwardly opening concavity for receipt of the lower end 6 of the receptacle 2 and an adhesive layer 16 preferably fixedly and permanently secures such receptacle's lower end within such concavity. In the single throw on/off switched embodiment of FIG. 4, a lower aspect of its cylindrical case 14 presents downwardly opening battery receiving cavities 22 and 32 for receipt of wafer batteries 60 and 62 between cavity embedded electric circuit completing electrodes 24 and 25, and 28 and 45. Referring further simultaneously to FIG. 1, such case component 14 preferably forms or includes an outwardly opening switch well 35 for receipt of and side wall support of a single throw on/off electrical switch 34.

Referring further to FIG. 4, the cylindrical case component 14 preferably includes and presents an annular and downwardly extending attachment flange 18, such flange 18 having an annular and outwardly extending snap attachment ridge 20. A disc shaped bulb mounting plate 38 is preferably provided as a further component of the attaching means, such plate 38 being nestingly received within the downwardly opening concavity which is defined by the annular flange 18. The plate 38 supports the light emitting diodes 42, and electrical conductors 40, 44, 47, and 46, and such plate 38 provides overlying and positioning support for a concave and downwardly directed light reflector 48. Upon receipt of the plate 38 within the cavity of flange 18, and upon rotary alignment of lug and detent combination 39, electrodes 40 and 46 which are embedded within and upwardly exposed upon plate 38 align with and contact electrodes 45 and 25, completing a bulb powering electrical circuit.

Referring further to the FIG. 4 switch configuration, a retainer ring 52 having an annular and inwardly opening snap channel 54 is fitted for receipt over flange 18. Upon installation of the retainer ring 52 as indicated in FIG. 4, such ring advantageously secures in place an elastomeric moisture barrier ring or washer 50. An inwardly extending and annular flange 56 at the lower end of the retainer ring 52 in a similar fashion retains a transparent lens 58 against the annular lower end of flange 18, and causes the lens 58 in turn to retain the concave reflector 48 against the concave lower face of plate 38.

In the alternatively switched configuration of Drawing FIGS. 5, 6, and 7, case 15 receives wafer batteries 60 and 62 within battery concavities 64 and 76, and case 15 receives and supports electrical conductor components 66, 68, 70, and 72, and 74. The case component 15 presents a peripheral, annular, and downwardly extending mounting flange 83 which includes an annular and inwardly opening snap attachment channel 82. A disc shaped lower case component 78 having an annular outwardly extending snap ridge 80 is fitted for nesting receipt within the downwardly opening concavity formed by flange 83. Upon engagement of snap ridge 80 within snap channel 82, such ridge and channel advantageously dually functions as attaching means and as a rotary bearing. The case component 78 preferably carries light emitting diodes 80 along with electrical conductors 84, 88, and 90. Electrodes 84 and 90 are preferably embedded within the floor of an upwardly opening circular channel 89 within the upper aspect of plate 78, the upper surfaces of such electrodes 84 and 90 being exposed within such channel 89 for alternative completing and breaking of an electrical circuit. Upon receipt of plate 78 within the concavity formed by flange 83, plate 78 is advantageously rotatable with respect to the upper case component 15, causing electrodes 74 and 66 to orbit within the circular channel 89 relative to the exposed electrodes 90 and 84. Upon such rotation, electrodes 74 and 66 may alternatively simultaneously contact electrodes 90 and 84, or may break their contact with such electrodes, alternatively completing and breaking the illuminating means' electrical circuit.

Referring further to the switching configuration of FIG. 5, the rotatable plate 78 preferably presents a specialized annular and outwardly extending flange 99 which advantageously secures a washer or ring 98 against the annular lower periphery of flange 83. The lower end of flange 99 preferably presents an annular shelf or stepped mounting land which receives a circular transparent lens 96. Such lens 96 is preferably mounted at and retained upon such stepped land by an annular inwardly extending snap ridge 89, the lens 96 and the snap ridge 89 securing in place an overlying concave reflector 94.

Figure 3:
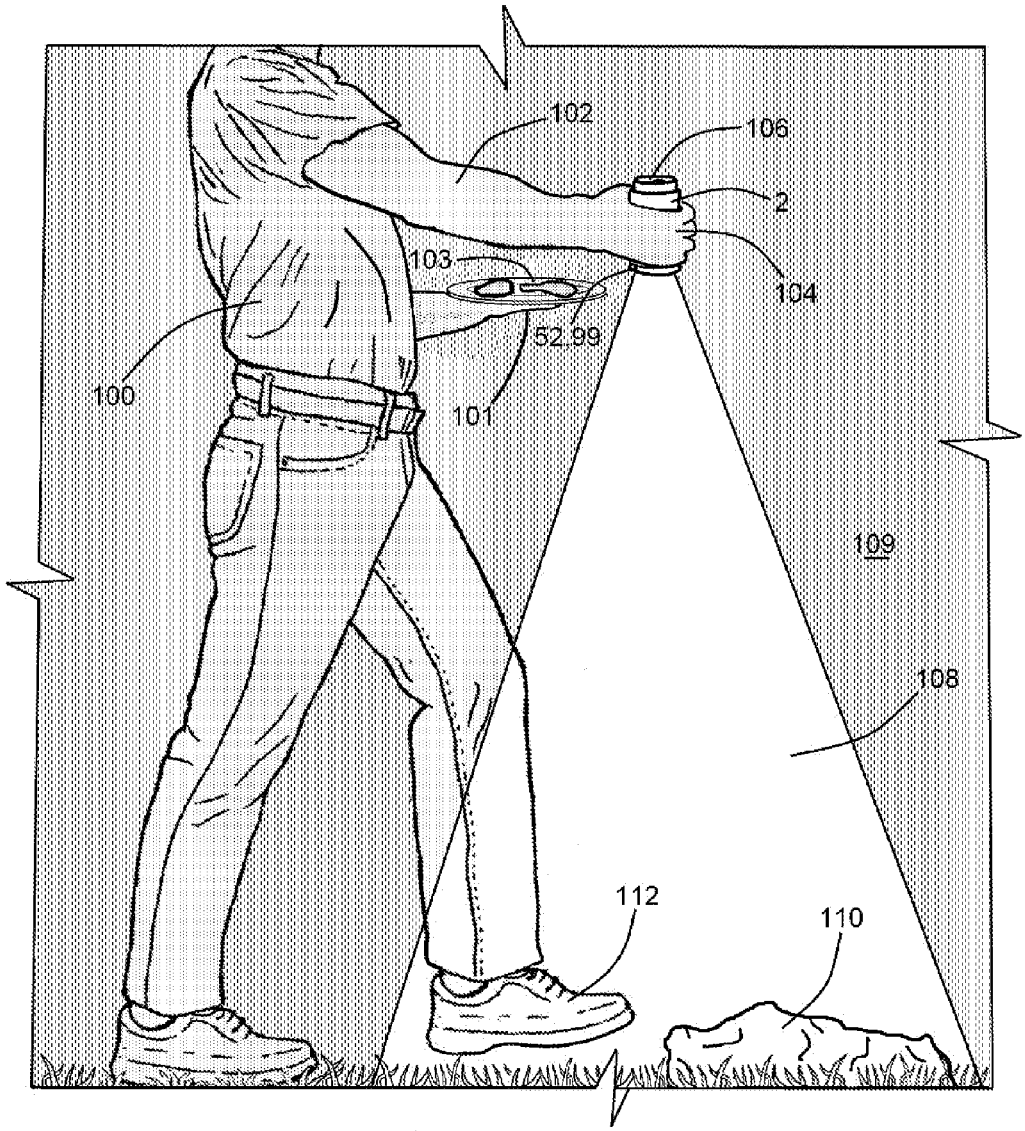
FIG. 3 shows the instant inventive apparatus in use by a user within a darkened area.

Referring simultaneously to FIGS. 3, 4 and 5, in use of the instant inventive apparatus for safe carriage of a drink vessel within a darkened area, a user 100 may conveniently insert or replace batteries 60 and 62 within their battery receiving cavities 22 and 32 or 64 and 76, as the case may be, by disengaging retainer ring 52 and removing plate 38, or by disengaging case component 78, as the case may be. Thereafter, assuming a provision of the configuration of FIG. 4, on/off switching of the preferred light emitting diodes 42 may be accomplished by the user's manipulation of the single throw electrical switch 34 which is exposed at the side wall of case component 14. In the alternatively switched configuration of FIG. 5, the user's manual rotation of case component 78 actuated via grasping and manual turning of flange 99 causes annular ridge 80 to rotate within annular channel 82 and simultaneously causes electrodes 66 and 74 to orbitally move within annular channel 89, such orbital motion causing such electrodes to perform an on/off switching function, alternatively contacting with or disconnecting from electrodes 84 and 90.

Referring to FIG. 3, following such user actuated battery insertion and illuminating means on/off switching, the user 100 may grasp the receptacle component 2 within one of his hands 104 and may insert a drink vessel such as a pop can 106 into the interior space 4 of the receptacle 2. Upon switching (either rotary or toggle switching) the illuminating means to an "on" position, and upon forward extension of the user's arm 102, light 108 casts downwardly through darkened areas 109, advantageously illuminating obstacles 110 which might otherwise remain unseen and might undesirably catch against the user's foot 112, tripping the user. By simultaneously illuminating potentially tripping objects 110 and facilitating carriage of the drink vessel 106, the instant inventive assembly advantageously frees the user's other hand 101 for carriage of other items and articles such as a plate of food 103. Accordingly, the instant inventive apparatus advantageously allows the user's two hands 101 and 104 to perform multiple article carrying functions while simultaneously downwardly performing the needed function of casting light 108 downwardly through darkness 109 for trip prevention.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An apparatus for safe carriage of a drink vessel within a darkened area, the apparatus comprising:

(a) a cylindrical receptacle having an upper opening and a lower end, the receptacle being fitted for receiving the drink vessel;

(b) illuminating means comprising at least a first light emitter selected from the group consisting of light emitting diodes, incandescent bulbs, and fluorescent bulbs, the illuminating means further comprising at least a first battery and a network of electrical conductors, the network of electrical conductors interconnecting the at least first battery and the at least first light emitter, the illuminating means further comprising switching means connected operatively to the network of electrical conductors; and (c) attaching means interconnecting the receptacle and the illuminating means, the attaching means positioning the illuminating means for casting light downwardly from the receptacle and through the darkened area, the attaching means comprising a case having an upper end attached to the cylindrical receptacle's lower end, the case housing the illuminating means' at least first light emitter, the at least first battery, the network of electrical conductors, and the switching means, wherein the receptacle comprises an insulating foam elastomer.

2. The apparatus of claim 1 further comprising a concave reflector, the concave reflector being supported at the case's lower end and being positioned for downwardly reflecting light emitted by the at least first light emitter.

3. The apparatus of claim 2 further comprising a transparent lens, the transparent lens being supported at case's lower end and being positioned to underlie the concave reflector and the at least first light emitter.

4. The apparatus of claim 3 wherein the switching means comprise an electric circuit completing and breaking mechanism selected from the group consisting of single throw on/off switches and rotary switches.

* * * * *